United States Patent [19]

Ohbu et al.

[11] 4,029,591

[45] June 14, 1977

[54] LIQUID DETERSIVE BLEACHING COMPOSITION

[75] Inventors: Kazuo Ohbu, Tokyo; Yuichi Takada, Kamagaya; Shigemi Nakamura, Tokyo, all of Japan

[73] Assignee: Lion Fat & Oil Co., Ltd., Tokyo, Japan

[22] Filed: Sept. 22, 1975

[21] Appl. No.: 615,393

[30] Foreign Application Priority Data

Sept. 27, 1974 Japan ..... 49-110591

[52] U.S. Cl. ..... 252/95; 252/103; 252/173; 252/553; 252/558; 252/DIG. 14

[51] Int. Cl.[2] ..... C11D 3/395; C11D 7/54

[58] Field of Search ..... 252/94, 95, 99, 103, 252/534, 553, DIG. 14, 173, 539, 540, 558, 559, 186, 187

[56] References Cited

UNITED STATES PATENTS

| | | | |
|---|---|---|---|
| 3,192,166 | 6/1965 | Smith | 252/DIG. 14 X |
| 3,393,154 | 7/1968 | Treitler | 252/554 X |
| 3,684,722 | 8/1972 | Hynam et al. | 252/98 |
| 3,728,266 | 4/1973 | Komeda et al. | 252/95 |
| 3,758,409 | 9/1973 | Nakagawa et al. | 252/99 |
| 3,850,831 | 11/1974 | Hellsten et al. | 252/99 |

*Primary Examiner*—Thomas J. Herbert, Jr.
*Assistant Examiner*—Bruce H. Hess
*Attorney, Agent, or Firm*—Woodhams, Blanchard and Flynn

[57] ABSTRACT

A liquid detersive bleaching composition which comprises 3 to 10 wt.% of sodium hypochlorite (in terms of the amount of available chlorine), 0.5 to 3 wt.% of caustic alkali, 0.3 to 7 wt.% of polyoxyethylene alkylphenyl ether sulfate (a) having the formula (I) and 0.1 to 5 wt.% of polyoxyethylene alkylphenyl ether sulfate sulfonate (b) having the formula (II), wherein the molar ratio of (a) to (b) is in the range of from 20/80 to 85/15 and the total amount of (a) and (b) is in the range of from more than 0.5 wt.% to less than 10 wt.%.

formula (I):

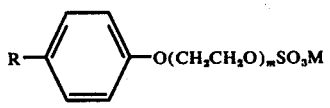

(wherein R represents straight-chain or branched-chain alkyl group having 5 to 15 carbon atoms, *m* is an integer ranging from 3 to 15, and M represents Na or K.)

formula (II):

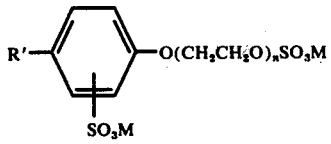

(wherein R′ represents straight-chain or branched-chain alkyl group having 5 to 15 carbon atoms, *n* is an integer ranging from 3 to 15, and M represents Na or K.)

5 Claims, No Drawings

LIQUID DETERSIVE BLEACHING COMPOSITION

BACKGROUND OF THE INVENTION

1. Field of the Invention

The present invention relates to a liquid detersive bleaching composition comprising sodium hypochlorite as the active bleaching ingredient, which composition is superior in bleaching efficiency, detergency, foaming efficiency and penetration into fabric.

2. Description of the Prior Art

Sodium hypochlorite has been known for a long time as a chemical having various effects such as disinfection, sterilization and bleaching. However, in the case of sodium hypochlorite prepared by the normal method, if it is not subjected to a particular purification, its aqueous solution tends to contain inorganic salt in an amount of about 0.5 to 1.5 times of the available amount of chlorine and at the same time a very small amount of heavy metal ion of, for instance, Ni, Cu, Co, etc. which are said to promote the decomposition of sodium hypochlorite. Accordingly, even when left standing, sodium hypochlorite would gradually decompose and the bleaching efficiency thereof would deteriorate, so that it is deficient in practicality. In order to make up for such defects, alkaline substances such as caustic soda have hitherto been added thereby to keep a certain degree of stability.

Further, as a means for enhancing the penetrating of sodium hypochlorite into fiber, fabric and the like and promoting the bleaching efficiency thereof, various processes of adding some surface active agent to sodium hypochlorite-based bleaching compositions have been proposed. However, inasmuch as the rate of decomposition of sodium hypochlorite is generally accelerated by the presence of organic substances in its solution, addition of surface active agents which are common detergent ingredients, such as anionic surface active agents like linear alkylbenzene sulfonate, alkyl sulfate, etc. and nonionic surface active agents like polyoxyethylene alkylphenyl ether, polyoxyethylene alkyl ether, etc., accelerates decomposition of sodium hypochlorite. Thus, we could not obtain a stable liquid detergent bleaching composition superior in bleaching power.

Therefore, as an alternative, there has been proposed application of such surface active agents that have less effect on the stability of hypochlorite even when mixed therewith. For instance, the Japanese Patent Publication No. 6268/1963 has a description about the effect that alkyl diphenyl ether disulfonate stabilizes sodium hypochlorite. However, there is no detailed description as to the degree of stabilization, and as a matter of fact, in the case of employment of an unrefined sodium hypochlorite, there is observed more deterioration of stability and increase in the rate of decomposition of sodium hypochlorite than in the case where no alkyl diphenyl ether disulfonate is added. Further, the Japanese Patent Publication No. 2103/1968 and Japanese Patent Publication No. 1086/1973 have descriptions to the effect that polyoxyethylene alkylphenyl ether sulfate can stably coexist with sodium hypochlorite in an aqueous solution. However, even in this case, the rate of decomposition of sodium hypochlorite is rather enhanced as compared with that in the case where no polyoxyethylene alkylphenyl ether sulfate is added. In other words, none of the known surface active agents which have been said to be able to coexist stably with sodium hypochlorite can prevent the decomposition of sodium hypochlorite; they are merely less active in accelerating the decomposition of sodium hypochlorite.

SUMMARY OF THE INVENTION

The present invention has been achieved as a result of inquiry into liquid detersive bleaching compositions comprising sodium hypochlorite as the active bleaching ingredient and having superior stability for a long time, and is based on the finding that, by joint application of two certain kinds of surface active agents at a specific ratio, the storage stability of the resulting composition can be improved compared with an aqueous solution of sodium hypochlorite not containing any surface active agent. In other words, the two kinds of surface active agents combined at a specific ratio act as if they were a stabilizer for sodium hypochlorite.

DETAILED DESCRIPTION OF THE INVENTION

The present invention provides a liquid detersive bleaching composition which comprises, as essential ingredients thereof, 3 to 10 wt.% of sodium hypochlorite (in terms of the amount of available chlorine), 0.5 to 3 wt.% of caustic alkali, 0.3 to 7 wt.% of polyoxyethylene alkylphenyl ether sulfate (a) having the following formula (I) and 0.1 to 5 wt.% of polyoxyethylene alkylphenyl ether sulfate sulfonate (b) having the following formula (II), wherein the molar ratio of (a) to (b) is in the range of from 20/80 to 85/15 and the sum of (a) and (b) is in the range of from more than 0.5 wt.% to less than 10 wt.%.

formula (I):

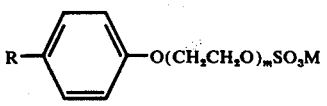

(wherein R represents straight-chain or branched-chain alkyl group having 5 to 15 carbon atoms, *m* is an integer ranging from 3 to 15, and M represents Na or K.)

forumula (II):

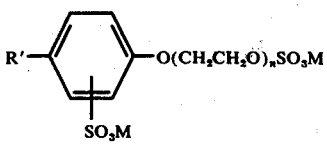

(wherein R′ represents straight-chain or branched-chain alkyl group having 5 to 15 carbon atoms, *n* is an integer ranging from 3 to 15, and M represents Na or K.)

Both of polyoxyethylene alkylphenyl sulfate and polyoxyethylene alkylphenyl sulfate sulfonate are known to be able to formulate relatively stably without much acceleration of the rate of decomposition of sodium hypochlorite, yet when compared with an aqueous solution of sodium hypochlorite without any surface active agent, the rate of decomposition is rather enhanced.

In the present invention, by incorporation of a certain limited amount of polyoxyethylene alkylphenyl ether sulfate (a) with polyoxyethylene alkylphenyl sulfate sulfonate (b) as essential ingredients at a certain limited ratio thereof, a liquid detersive bleaching composition is obtained in which not only is the decomposition rate of sodium hypochlorite decreased, but also the composition is more stable than a bleaching composition made only from sodium hypochlorite. The combination of the two surface active agents can be said to be a stabilizer. This constitutes a prominent characteristic of the present invention.

To be more precise, a liquid detersive bleaching composition according to the present invention comprises 0.3 to 7 wt.%, preferably 1 to 6 wt.%, of polyoxyethylene alkylphenyl ether sulfate (a) and 0.1 to 5 wt.%, preferably 0.5 to 4 wt.%, of polyoxyethylene alkylphenyl ether sulfate sulfonate (b), and the total amount of these surface active agents incorporated is in the range of from more than 0.5 wt.% to less than 10 wt.% and the molar ratio (a)/(b) is in the range of from 20/80 to 85/15, preferably from 60/40 to 80/20, whereby there appears a synergetic effect of lowering the decomposition rate and enhancing the stability of sodium hypochlorite as compared with an aqueous solution of sodium hypochlorite not containing any surface active agent.

Both of polyoxyethylene alkylphenyl ether sulfate (a) and polyoxyethylene alkylphenyl ether sulfate sulfonate (b) for use in the present invention can be obtained by sulfation of polyoxyethylene alkylphenyl ether with sulfuric anhydride. In this connection, according to a report by Gilverts [cf. J.A.O.C.S, vol. 37, P.298 (1960)], by reacting of 1 mole of sulfuric anhydride with polyoxyethylene alkylphenyl ether at a reaction temperature of 60° C, 11 mol % of the phenyl groups were sulfonated, and by reacting of 1.3 mole of sulfuric anhydride with polyoxyethylene alkylphenyl ether at the same temperature, 18 mol % of the phenyl groups were sulfonated.

However, since the increase of the molar ratio of sulfation reagent to the phenyl ether would lead to a remarkable increase of coloring of the reaction product, sulfation has hitherto been effected by applying just an equal or slight excess of the sulfating agent, resulting in failure to obtain surface active agents capable of showing such synergetic effect as in the present invention. According to the present invention, it is possible to effect sulfation so as to attain a specified ratio of sulfuric ester to sulfuric ester sulfonic acid, by the use of about 1.2 to 2.0 moles of sulfuric anhydride relative to polyoxyethylene alkylphenyl ether. Also, it is possible to prepare sulfuric ester or salt thereof and sulfuric ester sulfonic acid or salt thereof separately and mix them at a specified ratio.

In said polyoxyethylene alkylphenyl ether sulfate (a) and polyoxyethylene alkylphenol ether sulfate sulfonate (b), the alkyl group has 5 to 15, preferably 7 to 12, carbon atoms, and it may be either straight chain or branched chain. Further, the average mole number of added ethylene oxide is in the range of from 3 to 15 and can be optionally selected considering any other performance to be required. As sodium benzenesulfonate has no effect on the decomposition of sodium hypochlorite, the use thereof jointly with the surface active agents according to the present invention will bring about a further satisfactory result. The appropriate amount of this sodium benzenesulfonate is less than 10 wt.%.

Besides, in the case where the total amount of the combined surface active agents according to the present invention is more than 0.5 wt.%, replacement of about one third of the whole amount of surface active agents with conventional surface active agents will scarcely exert any harmful influence upon the stabilization efficiency.

As sodium hypochlorite for use in the present invention, all sodium hypochlorites prepared by the conventional method as well as those subjected to refining process are also applicable. The appropriate amount of sodium hypochlorite to be formulated is in the range of from 3 to 10 wt.% in terms of the amount of available chlorine; application of an amount of less than 3 wt.% will result in poor bleaching efficiency of the product, while application of an amount of more than 10 wt.% will increase the instability of sodium hypochlorite, and therefore both are undesirable.

Addition of caustic alkali is for the purpose of preventing the decomposition of sodium hypochlorite, and the appropriate amount thereof for use in the present invention is in the range of from 0.5 to 3.0 wt.% as applied to liquid detersive bleaching composition.

The rate of decomposition of sodium hypochlorite can be decreased most significantly, so the solution can keep a stable appearance and further the amount of available chlorine can be maintained at a high level. Therefore, by virtue of the action of surface active agents contained therein, the present liquid detersive bleaching composition has such effects as providing an appropriate foaming ability, improving the penetration of sodium hypochlorite into colored soil attached to fibers or the hard surface of tableware, tile, etc. and cleansing effect, in addition to the effect of improving the stability of sodium hypochlorite.

DESCRIPTION OF THE PREFERRED EMBODIMENTS

EXAMPLE 1

By employing sodium hypochlorite comprising 12.6% of available chlorine, 7.2% of sodium chloride and 0.32% of free alkali (as NaOH), liquid detersive bleaching compositions consisting of the following components were prepared. These compositions proved to have a satisfactory foaming ability as well as detergency. When these compositions were respectively put in an opaque vessel with the following substances and left standing still in a room for 60 days, the rate of decomposition of sodium hypochlorite was as shown in the following table.

| | |
|---|---|
| NaOCl | 6.0 wt.% (in terms of available chlorine) |
| sodium benzene sulfonate | 1.0 wt.% |
| surface active agent (the sum of a and b) | 2.0 wt.% |
| caustic soda | 1.5 wt.% |
| deionized water | balance |
| (Surface active agent-a) Sodium polyoxyethylene nonylphenyl ether sulfate | (average added mole number of ethylene oxide $\bar{p} = 8.6$) |

-continued

| (Surface active agent-b) Disodium polyoxyethylene nonylphenyl ether sulfate sulfonate | | | | (average added mole number of ethylene oxide $\bar{p} = 8.6$) | | | |
|---|---|---|---|---|---|---|---|
| Experiment No. | 1 | 2 | 3 | 4 | 5 | 6 | 7 |
| molar ratio of activators a/b | 100/0 | 90/10 | 85/15 | 80/20 | 50/50 | 30/70 | 0/100 |
| rate of decomposition of NaOCl (%) | 73 | 44 | 23 | 19 | 17 | 28 | 56 |

Experiment No. 3–6: examples of the invention
Experiment No. 1, 2, 7: comparative experiments

EXAMPLE 2

By employing the same sodium hypochlorite as in Example 1, liquid detersive bleaching compositions consisting of the following components were prepared.

| | |
|---|---|
| NaOCl | 6.0 wt. % (in terms of available chlorine) |
| sodium benzenesulfonate | 1.0 wt. % |
| surface active agent (in total amount) | 3.0 wt. % |
| caustic soda | 1.5 wt. % |
| deionized water | balance |

As the surface active agent, the following combinations of two substances having the molar ratio a/b=70/30 were applied.

| | | | |
|---|---|---|---|
| 1 | (a) | Sodium polyoxyethylene octylphenyl ether sulfate | (average added mole number of ethylene oxide $\bar{p} = 4.5$) |
| | (b) | Disodium polyoxyethylene octylphenyl ether sulfate sulfonate | (average added mole number of ethylene oxide $\bar{p} = 4.5$) |
| 2 | (a) | Sodium polyoxyethylene octylphenyl ether sulfate | (average added mole number of ethylene oxide $\bar{p} = 10.6$) |
| | (b) | Disodium polyoxyethylene octylphenyl ether sulfate sulfonate | (average added mole number of ethylene oxide $\bar{p} = 10.6$) |
| 3 | (a) | Sodium polyoxyethylene octylphenyl ether sulfate | (average added mole number of ethylene oxide $\bar{p} = 15$) |
| | (b) | Disodium polyoxyethylene octylphenyl ether sulfate sulfonate | (average added mole number of ethylene oxide $\bar{p} = 15$) |
| 4 | (a) | Sodium polyoxyethylene docecylphenyl ether sulfate | (average added mole number of ethylene oxide $\bar{p} = 9.6$) |
| | (b) | Disodium polyoxyethylene dodecylphenyl ether sulfate sulfonate | (average added mole number of ethylene oxide $\bar{p} = 9.6$) |

When tests were conducted in the same way as in Example 1, the rate of decomposition of sodium hypochlorite was as shown in the following table.

| Experiment No. | 1 | 2 | 3 | 4 |
|---|---|---|---|---|
| rate of decomposition of NaCOl (%) | 36 | 25 | 30 | 21 |

EXAMPLE 3

By employing the same sodium hypochlorite as in Example 1, varieties of liquid detersive bleaching compositions consisting of the following components were prepared.

| | |
|---|---|
| NaOCl | 5.0 wt. % (in terms of available chlorine) |
| sodium benzenesulfonate | 0.5 wt. % |
| surface active agent (in total amount) | 0 – 15 wt. % |
| caustic soda | 1.5 wt. % |
| deionized water | balance |

Composition of activator:
(a) Sodium polyoxyethylene nonylphenyl ether sulfate (ethylene oxide $\bar{p} = 5.5$)
(b) Disodium polyoxyethylene nonylphenyl ether sulfate sulfonate (ethylene oxide $\bar{p} = 5.5$)
(a)/(b) = 80/20

When tests were conducted in the same way as in Example 1, the rate of decomposition of sodium hypochlorite was as shown in the following table.

| Experiment No. | 1 | 2 | 3 | 4 | 5 | 6 | 7 | 8 |
|---|---|---|---|---|---|---|---|---|
| amount of activator employed (%) | 0 | 0.2 | 0.5 | 5 | 7 | 9 | 10 | 15 |
| rate of decomposition of NaOCl (%) | 23 | 23 | 22 | 19 | 20 | 21 | 27 | 60 |

Experiment No. 3 – 6: Example of the invention
Experiment No. 1, 2, 7, 8: comparative examples

What is claimed is:

1. A liquid detersive bleaching composition, consisting essentially of:

a. from 0.3 to 7 weight percent of a substance having the formula

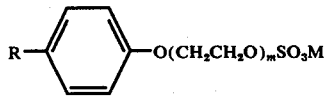

wherein R is alkyl having 5 to 15 carbon atoms, *m* is an integer from 3 to 15, and M is Na or K;

b. from 0.1 to 5 weight percent of a substance having the formula

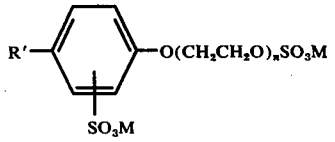

wherein R′ is alkyl having 5 to 15 carbon atoms, *n* is an integer from 3 to 15, and M is Na or K, he sum of component a plus component *b* being from nore than 0.5 weight percent to less than 10 weight ercent, and the molar ratio of *a/b* being in the range of rom 20/80 to 85/15;

c. from 3 to 10 weight percent, calculated as available chlorine, of sodium hypochlorite;

d. from 0.5 to 3 weight percent of caustic alkali;

e. up to less than 10 weight percent of sodium benzenesulfonate; and f. the balance is essentially water.

2. A composition as claimed in claim 1 in which the amount of component a is from one to 6 weight percent, and the amount of component b is from 0.5 to 4 weight percent.

3. A composition as claimed in claim 2 in which the molar ratio a/b is from 60/40 to 80/20.

4. A composition as claimed in claim 2 in which R and R′ have from 7 to 12 carbon atoms.

5. A composition as claimed in claim 3 in which R and R′ have from 7 to 12 carbon atoms.

* * * * *